US009054453B2

(12) United States Patent
Sekine et al.

(10) Patent No.: US 9,054,453 B2
(45) Date of Patent: Jun. 9, 2015

(54) CONNECTOR

(75) Inventors: Takashi Sekine, Kanagawa (JP); Kenichi Yamaguchi, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 77 days.

(21) Appl. No.: 13/978,900

(22) PCT Filed: Jan. 11, 2012

(86) PCT No.: PCT/JP2012/050339

§ 371 (c)(1),
(2), (4) Date: Jul. 10, 2013

(87) PCT Pub. No.: WO2012/096288

PCT Pub. Date: Jul. 19, 2012

(65) Prior Publication Data

US 2013/0288508 A1 Oct. 31, 2013

(30) Foreign Application Priority Data

Jan. 12, 2011 (JP) ..... 2011-004053
Jul. 15, 2011 (JP) ..... 2011-156439

(51) Int. Cl.
*H01R 13/629* (2006.01)
*H01R 12/51* (2011.01)
*H01R 12/70* (2011.01)
(Continued)

(52) U.S. Cl.
CPC ..... *H01R 13/629* (2013.01); *F21K 9/135* (2013.01); *F21V 19/004* (2013.01); *F21V 23/06* (2013.01); *F21Y 2101/02* (2013.01); *H01R 12/515* (2013.01); *H01R 12/721* (2013.01); *F21V 3/00* (2013.01); *H01R 12/7029* (2013.01); *H01R 12/714* (2013.01)

(58) Field of Classification Search
USPC ..... 439/345, 733.1, 660, 620; 313/45
See application file for complete search history.

(56) References Cited

U.S. PATENT DOCUMENTS 8,550,837 B2 * 10/2013 Tagawa et al. ..... 439/345
2010/0026157 A1 * 2/2010 Tanaka et al. ..... 313/45
2013/0012066 A1 * 1/2013 Hirakawa ..... 439/620.01

FOREIGN PATENT DOCUMENTS

JP 4-133381 12/1992
JP 6-68318 9/1994
JP 10-302914 11/1998
JP 2003-249291 9/2003
(Continued)

OTHER PUBLICATIONS

International Search Report From Corresponding Application No. PCT/JP2012/050339.

*Primary Examiner* — Alexander Gilman
(74) *Attorney, Agent, or Firm* — Lowe Hauptman & Ham, LLP

(57) ABSTRACT

To provide a connector with which a terminal can be easily connected to a substrate without soldering. A connector (10) is configured such that a contact portion (13*b*) formed at a terminal (13) so as to be elastically deformable in the vertical direction is brought into contact with the upper surface of an LED substrate (3) and is thereby made conductive with the LED substrate (3), and such that a locking portion (14*c*) of each of locking members (14) is locked to the lower surface of a mounting substrate (4), and thereby the contact portion (13*b*) of the terminal (13) is held in a state of being in press-contact with the upper surface of the LED substrate (3). Thereby, the terminal (13) can be easily connected to the LED substrate (3) without soldering, and hence the mounting work of the connector (10) can be performed very easily.

15 Claims, 18 Drawing Sheets

(51) Int. Cl.

| | |
|---|---|
| *F21K 99/00* | (2010.01) |
| *F21V 19/00* | (2006.01) |
| *F21V 23/06* | (2006.01) |
| *F21Y 101/02* | (2006.01) |
| *H01R 12/72* | (2011.01) |
| *F21V 3/00* | (2006.01) |
| *H01R 12/71* | (2011.01) |

(56) References Cited

FOREIGN PATENT DOCUMENTS

| | | |
|---|---|---|
| JP | 2009-117182 | 5/2009 |
| JP | 2010-33959 | 2/2010 |
| JP | 1385523 | 4/2010 |

* cited by examiner

CONNECTOR

TECHNICAL FIELD

The present invention relates to a connector which is mounted, for example, to a substrate of a light-bulb type lamp using an LED and which is used for connecting the substrate to a power supply cable.

BACKGROUND ART

Generally, as a light-bulb type lamp using an LED, there is known a type which is configured by a main body portion attached to a lighting apparatus, a substrate with an LED mounted thereto, and a spherical cover covering the substrate, and which is configured to irradiate the light of the LED on the substrate to the outside through the cover (see, for example, Patent Literature 1). Similarly to a conventional light bulb, this light-bulb type lamp is configured such that a base which is screwed to a socket of the lighting apparatus is provided at the main body portion, and such that external electric power is supplied to the LED via a wiring connecting the base to the substrate. In this case, a connector, which connects the wiring cable to the conductive pattern of the substrate, is mounted to the substrate.

The connector used for this light-bulb type lamp includes a connector main body inserted into a mounting hole provided in the substrate, and a terminal held at the connector main body, and is configured such that one end side of the terminal is connected to the LED mounting surface of the substrate, and such that the other end side of the terminal is connected to the cable (see, for example, Patent Literature 2).

CITATION LIST

Patent Literature

Patent Literature 1: Japanese Patent Publication No. 2010-33959

Patent Literature 2: Japanese Design Registration No. 1385523

SUMMARY OF INVENTION

Technical Problem

However, the conventional connector is configured such that the connector main body is inserted into the mounting hole and then the one end side of the terminal is connected to the substrate by soldering. Therefore, the conventional connector has a problem that the soldering work of the terminal is required at the time of mounting the connector and hence the mounting work of the connector becomes complicated.

The present invention has been made in view of the above described problem. An object of the present invention is to provide a connector which can be connected to a substrate easily without soldering a terminal to the substrate.

Solution to Problem

In order to achieve the above-described object, a connector according to the present invention includes a connector main body inserted into a mounting hole provided in a plate-like mounting object, and an a terminal held at the connector main body, the terminal being connected to one surface in a thickness direction of the mounting object, the connector including: a contact portion which is formed at the terminal so as to be elastically deformable in the thickness direction of the mounting object and which is made conductive with the mounting object by being brought into contact with the one surface in the thickness direction of the mounting object; and a locking member which is mounted to the connector main body and which is provided with a locking portion that is locked to the other surface in the thickness direction of the mounting object to thereby hold the contact portion of the terminal in a state where the contact portion is in press-contact with the one surface in the thickness direction of the mounting object, in which the locking member is formed so that a gap between the contact portion and the locking portion is smaller than a thickness dimension of the mounting object, the connector main body is held at the mounting object by the mounting object being sandwiched between the contact portion and the locking portion, and the connector main body is formed so as to be able to mount therein a plurality of kinds of locking members respectively having different gaps between the contact portion and the locking portion.

With such configuration, the contact portion formed at the terminal so as to be elastically deformable in the vertical direction is brought into contact with the one surface in the thickness direction of the mounting object, so that the contact portion and the mounting object are made conductive with each other. Also, the locking portion is locked to the other surface of the substrate in the thickness direction, so that the contact portion of the terminal is held in a state of being in press-contact with the one surface of the mounting object in the thickness direction. Thereby, the terminal can be connected to the mounting object without soldering. Further, the terminal can be attached to the other mounting object having a different thickness dimension by replacing the locking member with another kind of locking member having a different gap between the contact portion and the locking portion. The versatility of the connector can be improved.

Advantageous Effects of Invention

According to the present invention, the terminal can be connected to the substrate without soldering, and hence the mounting work of the connector can be performed very easily. Further, the terminal can be attached to another mounting object having a different dimension, and hence the versatility of the connector can be improved.

DESCRIPTION OF EMBODIMENTS

Figure 1:
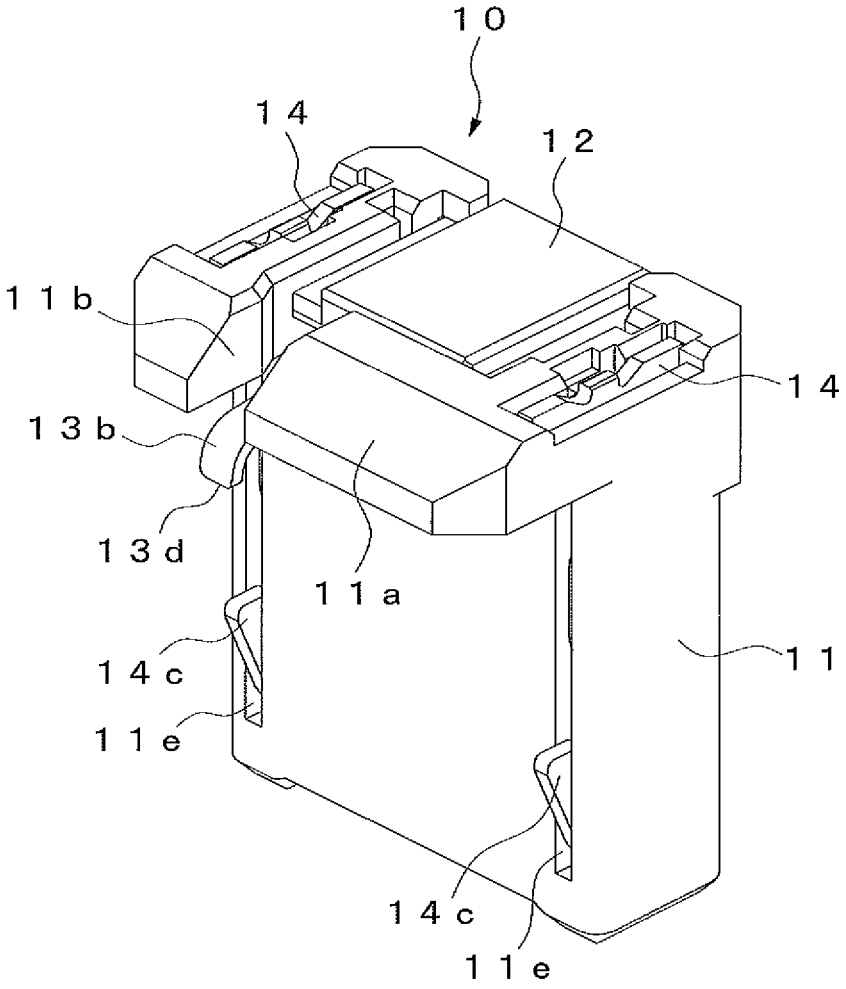
FIG. 1 is an upper side perspective view of a connector showing a first embodiment according to the present invention.
Figure 2:
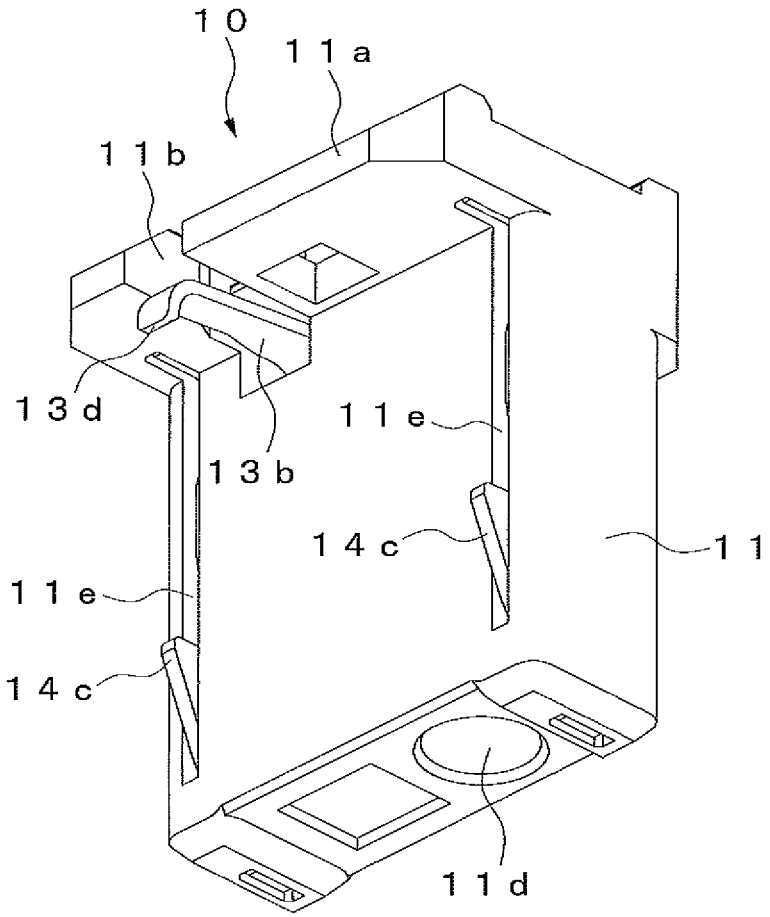
FIG. 2 is a lower side perspective view of the connector.
Figure 3:
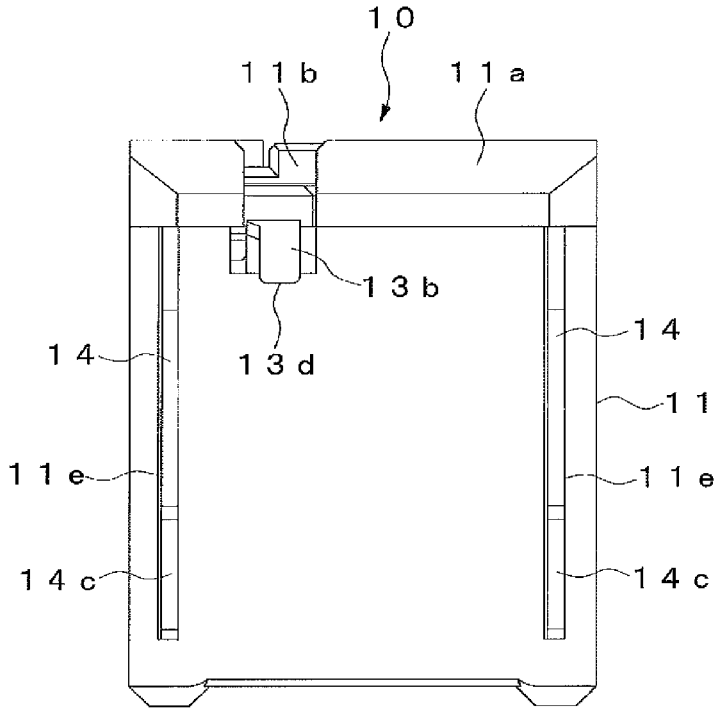
FIG. 3 is a front view of the connector.
Figure 4:
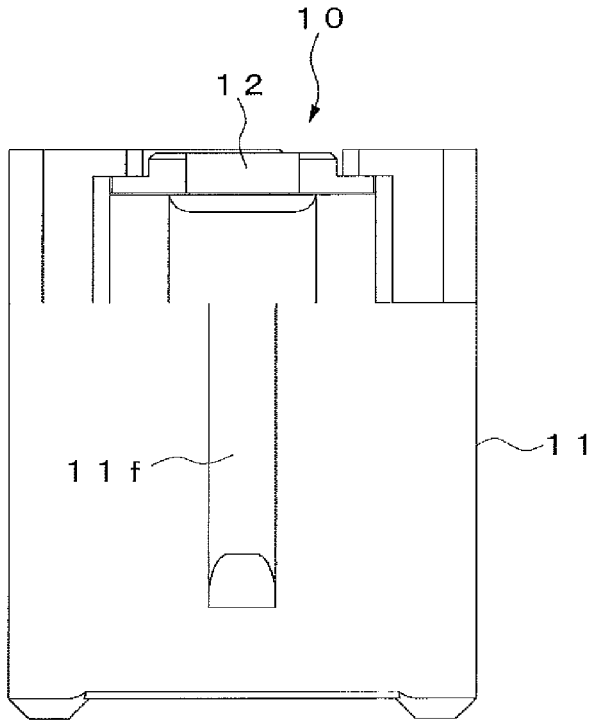
FIG. 4 is a rear view of the connector.
Figure 5:
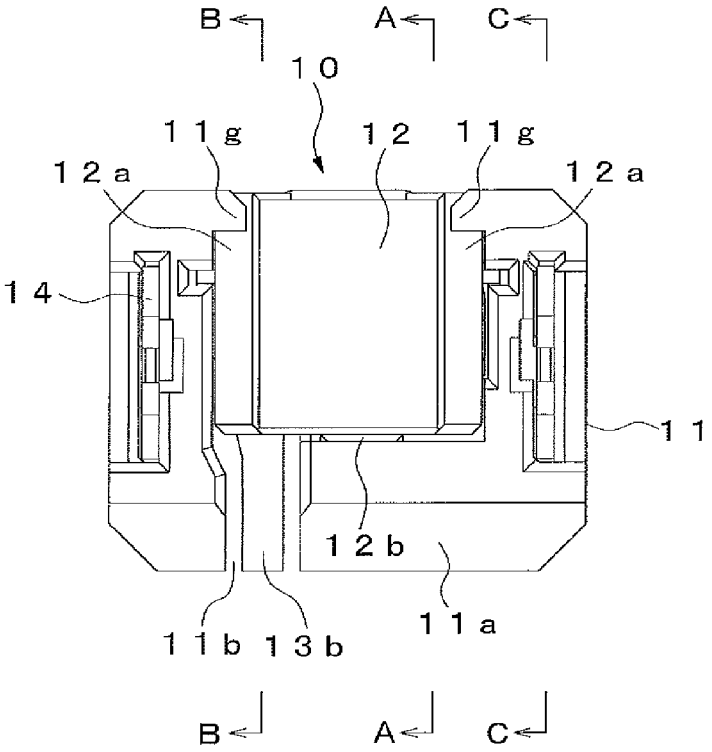
FIG. 5 is a plan view of the connector.
Figure 6:
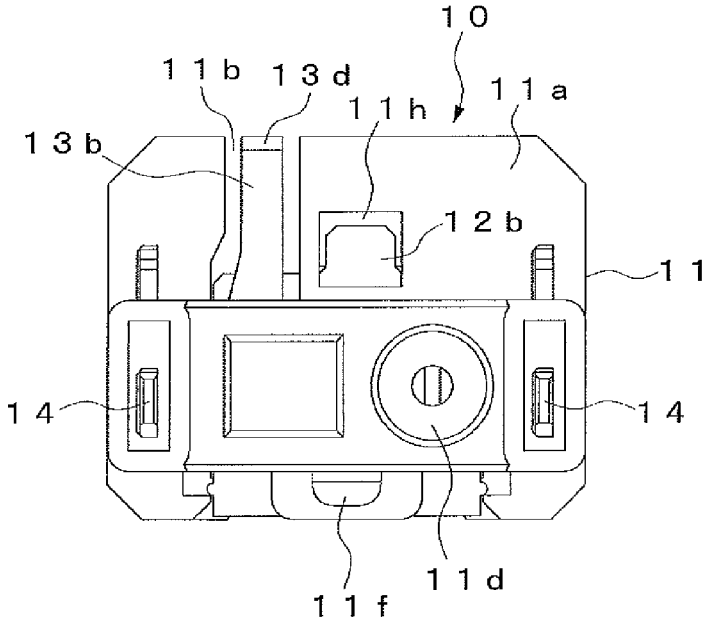
FIG. 6 is a bottom view of the connector.
Figure 7:
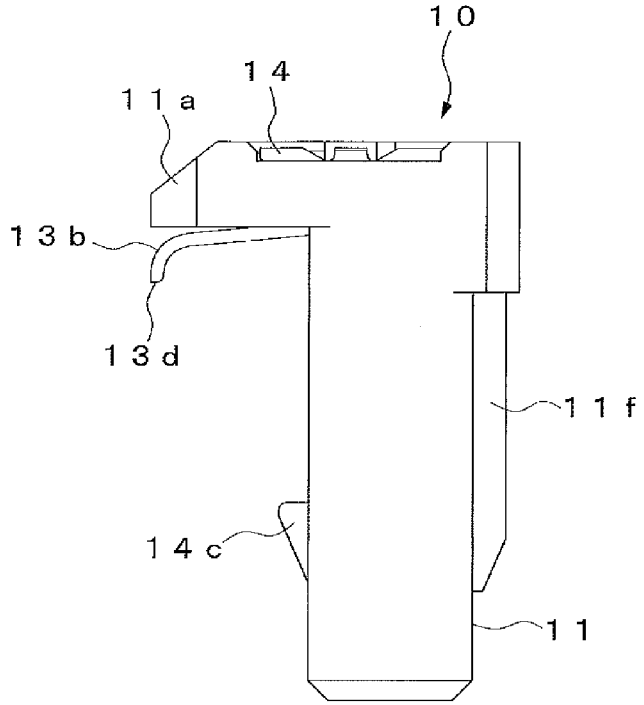
FIG. 7 is a side view of the connector.
Figure 8:
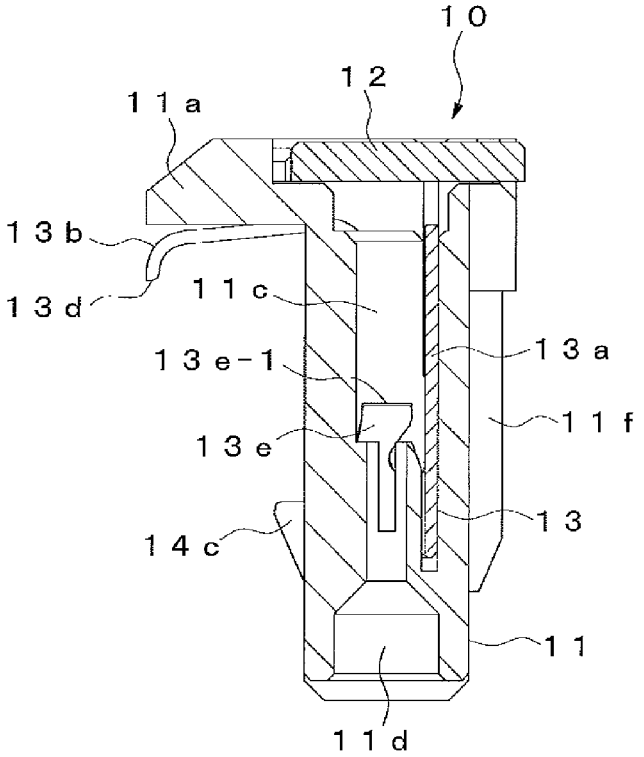
FIG. 8 is a sectional view along the line A-A in FIG. 5.
Figure 9:
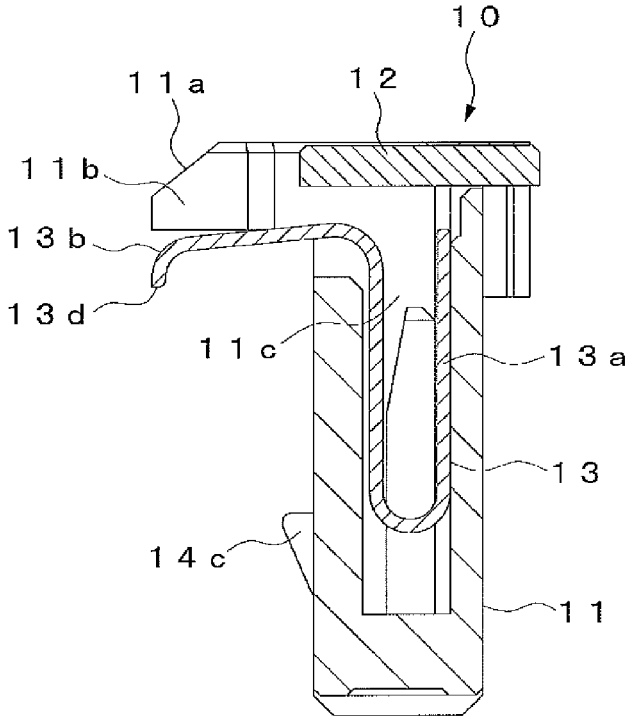
FIG. 9 is a sectional view along the line B-B in FIG. 5.
Figure 10:
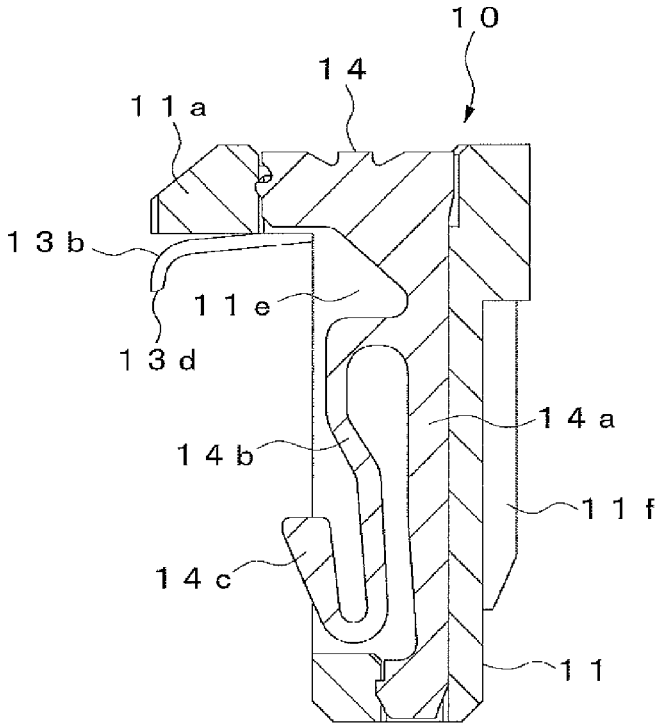
FIG. 10 is a sectional view along the line C-C in FIG. 5.
Figure 11:
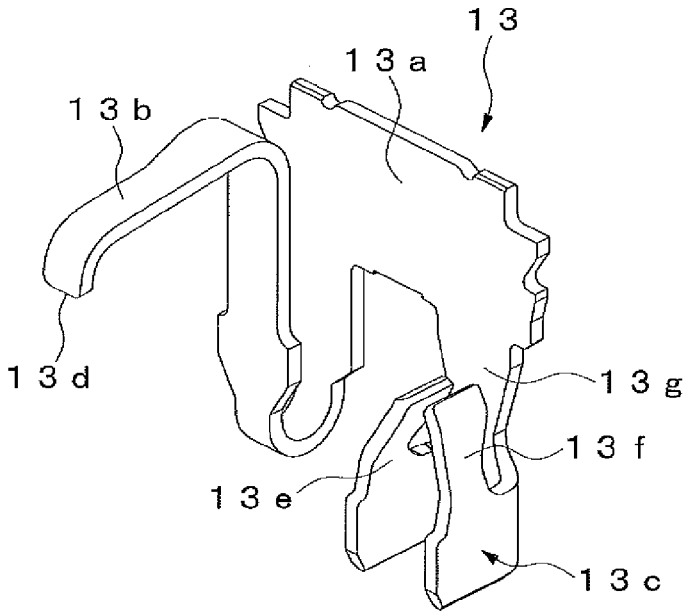
FIG. 11 is a perspective view of a terminal.
Figure 12:
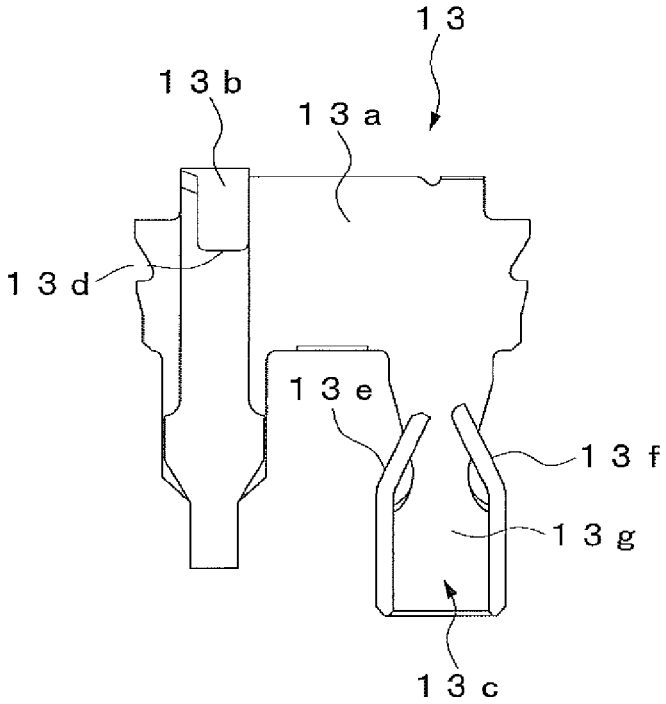
FIG. 12 is a front view of the terminal.
Figure 13:
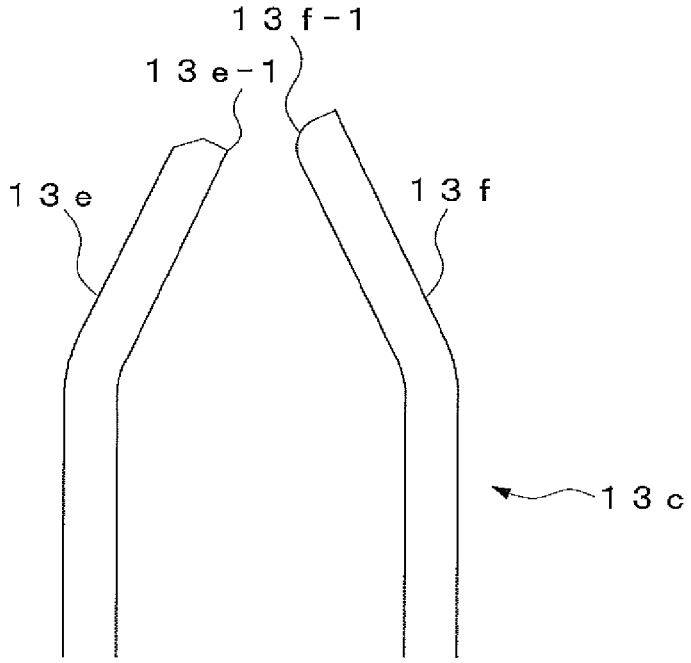
FIG. 13 is a front view of a main portion of the terminal.

FIG. 1 to FIG. 23 show a first embodiment according to the present invention. A connector shown in the figures is mounted to a substrate of a light-bulb type lamp using an LED and is used for connecting a power supply cable as a connection object to the substrate.

A light-bulb type lamp 1 shown in the figures is configured by a main body portion 2 attached to a lighting apparatus, an LED substrate 3 with an LED mounted on the upper surface thereof, a mounting substrate 4 with the LED substrate 3 mounted on the upper surface thereof, and a spherical cover 5 covering the upper side of the LED substrate 3 and the mounting substrate 4, and is configured to irradiate the light of the LED to the outside through the cover 5. Note that the LED substrate 3 and the mounting substrate 4 form a plate-like mounting object.

The main body portion 2 is formed with a hollow case having an opening on the upper surface thereof. A base 2*a*, which is screwed to a socket (not shown) of the lighting apparatus, is provided at the lower end of the main body portion 2. The base 2*a* is connected to the LED substrate 3 via a cable 6 so that external electric power is supplied to the LED substrate 3 from the base 2*a*.

The LED substrate 3 is formed in a quadrangular shape, and is fixed to the upper surface of the mounting substrate 4 so as to overlap the upper surface of the mounting substrate 4. In this case, one LED 3*a* formed in a flat shape is mounted to the LED substrate 3. Note that, in FIG. 16, FIG. 17 and FIG. 22, only a part of the LED substrate 3 and of the mounting substrate 4 is illustrated.

The mounting substrate 4 is formed in a disc shape so as to be fixed to the upper surface of the main body portion 2. A connector 10, which connects the cable 6 to the LED substrate 3, is mounted to the mounting substrate 4, and the connector 10 is fitted into a mounting hole 4*a* provided in the mounting substrate 4. The mounting hole 4*a* is formed as a quadrangular through hole arranged at each of both end sides of the LED substrate 3, and one width-direction inner surface of the mounting hole 4*a* is located to form the same plane with the end surface of the LED substrate 3. Further, a recessed portion 4*b* engaging with a part of the connector 10 described below is provided at the other width-direction inner surface of the mounting hole 4*a*.

The connector 10 includes a connector main body 11 inserted into the mounting hole 4*a* of the mounting substrate 4, an upper surface cover 12 covering the upper surface of the connector main body 11, an electrical connection terminal 13 held at the connector main body 11, and a pair of locking members 14 locked to the connector main body 11, and is configured such that one end side of the terminal 13 is made conductive with the upper surface (one surface in the thickness direction) of the LED substrate 3, and such that the cable 6 is connected to the other end side of the terminal 13.

The connector main body 11 is formed by a synthetic resin molding, and is formed in an elongated rectangular parallelepiped shape in which the front-rear direction dimension is smaller than the width-direction dimension. An extension portion 11*a* extending frontward is provided on the upper surface side of the connector main body 11, and a notch lib, into which the one end side of the terminal 13 is inserted, is provided at a portion close to one width-direction end of the extension portion 11*a*. A terminal housing portion 11*c*, which houses the terminal 13 therein, is provided in the connector main body 11, and the upper surface of the terminal housing portion 11*c* is opened at the upper surface of the connector main body 11. A circular insertion port 11*d*, into which the cable 6 is inserted, is provided at a portion close to the other width-direction end of the lower surface of the connector main body 11, and the insertion port 11*d* is made to communicate with the inside of the terminal housing portion 11*c*. A holding hole 11*e* for holding each of the locking members 14 is provided at each of both width-direction sides of the inside of the connector main body 11. Each of the holding holes 11*e* is opened in the front surface of the connector main body 11 so as to extend in the vertical direction, and the opened portion is formed in the front surface of the connector main body 11 except the extension portion 11*a* so as to have a length substantially covering the entire vertical length of the front surface of the connector main body 11. A rib 11*f* extending in the vertical direction is projectingly provided on the rear surface of the connector main body 11, and the rib 11*f* is arranged at the width-direction center of the connector main body 11.

The upper surface cover 12 is formed into a quadrangular plate shape covering the upper surface opening portion of the terminal housing portion 11*c*, and is configured to be attached to the upper surface side of the connector main body 11 by being mounted to the connector main body 11 from the rear side of the connector main body 11. A flange portion 12*a* extending in the front and rear direction is provided at each of both width-direction sides of the upper surface cover 12. Each of the flange portions 12*a* is configured to engage, from below, with each of a pair of locking portions 11*g* which are arranged in the width direction of the terminal housing portion 11*c* and which are provided at the rear end side of the upper surface opening portion of the terminal housing portion 11*c*. A projecting portion 12*b* projecting frontward is provided at the front end of the upper surface cover 12. The projecting portion 12*b* is configured to engage with a hole 11*h* provided on the front end side of the upper surface opening portion of the terminal housing portion 11*c*.

The terminal 13 is formed by a bent conductive metal plate, and is housed in the terminal housing portion 11*c* of the connector main body 11 by being inserted into the terminal housing portion 11*c* from the upper surface opening portion of the terminal housing portion 11*c*. The terminal 13 is configured by a fixed piece portion 13*a* formed in a plate shape, a contact portion 13*b* extending from one width-direction end side of the fixed piece portion 13*a*, and a cable connecting portion 13*c* extending from the other width-direction end side of the fixed piece portion 13*a*.

The fixed piece portion 13*a* is configured to be fixed to the terminal housing portion 11*c* in such a manner that both the width-direction ends of the fixed piece portion 13*a* are brought into press-contact with the inner surfaces of the terminal housing portion 11*c*.

The contact portion 13*b* is formed so that it extends downward from the fixed piece portion 13*a* and is bent upward so as to further extend to the front side. The contact portion 13*b* is formed to be elastically deformable in the vertical direction (in the thickness direction of the LED substrate 3 and the mounting substrate 4), and a contact 13*d* which is brought into contact with the LED substrate 3 is provided at the distal end of the contact portion 13*b* so as to be bent downward.

The cable connecting portion 13*c* extends downward from the fixed piece portion 13*a*. Also, on both width-direction sides of the cable connecting portion 13*c*, a pair of first and second contact pieces 13*e* and 13*f*, between which a conducting wire 6*a* of the cable 6 is sandwiched, are provided so as to face each other. Each of the contact pieces 13*e* and 13*f* is formed in such a manner that both width-direction sides of an extension portion 13*g* (a predetermined portion of the terminal body) extending downward from the fixed piece portion 13*a* are bent frontward and raised so as to face each other, and that the distal end side of the raised portions extending upward are inclined so as to become closer to each other. In this case, the distal end side of each of the contact pieces 13*e* and 13*f* is formed to be elastically deformable in the width direction of the cable connecting portion 13*c* (in the direction in which the contact pieces 13*e* and 13*f* face each other). A first contact portion 13*e*-1, which is brought into biting contact with the conducting wire 6*a* of the cable 6, is provided at a distal end corner portion of the first contact piece 13*e*. The first contact portion 13*e*-1 is formed as a corner portion having a substantially right-angled cross section. A second contact portion 13*f*-1, which is slidably brought into surface contact with the conducting wire 6*a* of the cable 6, is provided at a distal end of the second contact piece 13*f*. The second contact portion 13*f*-1 is formed in such a manner that the distal end corner portion of the second contact piece 13*f* is chamfered to a curved surface shape. In this case, the contact portions 13*f*-1 and 13*e*-1 are arranged so as to face each other in the width direction of the cable connecting portion 13*c* (in the direction perpendicular to the insertion direction of the cable 6).

Each of the locking members 14 is made of a metal plate formed by punching and is mounted to the connector main body 11. The locking member 14 is configured by a fixed piece portion 14*a* extending from the upper end to the lower end of the inside of the holding hole 11*e*, an elastic piece portion 14*b* extending from the fixed piece portion 14*a*, and a locking portion 14*c* provided at the distal end of the elastic piece portion 14*b*. The locking portion 14*c* is configured to be locked to the lower surface (the other surface in the thickness direction) of the mounting substrate 4. The fixed piece portion 14*a* is configured to be fixed to the holding hole 11*e* in such manner that both front and rear ends of each of the upper and lower end sides of the fixed piece portion 14*a* are brought into press-contact with the inner surface of the holding hole 11*e*. The elastic piece portion 14*b* is formed to extend downward in front of the fixed piece portion 14*a* and to be further bent upward in front of the downward extending portion. The locking portion 14*c* is formed to project frontward from the distal end of the elastic piece portion 14*b*, and projects from the opening portion of the holding hole 11*e* to the front of the connector main body 11. In this case, the upper end of the locking portion 14*c* is formed horizontally, and the lower end side of the locking portion 14*c* is formed in a shape inclined rearward and downward.

Figure 18:
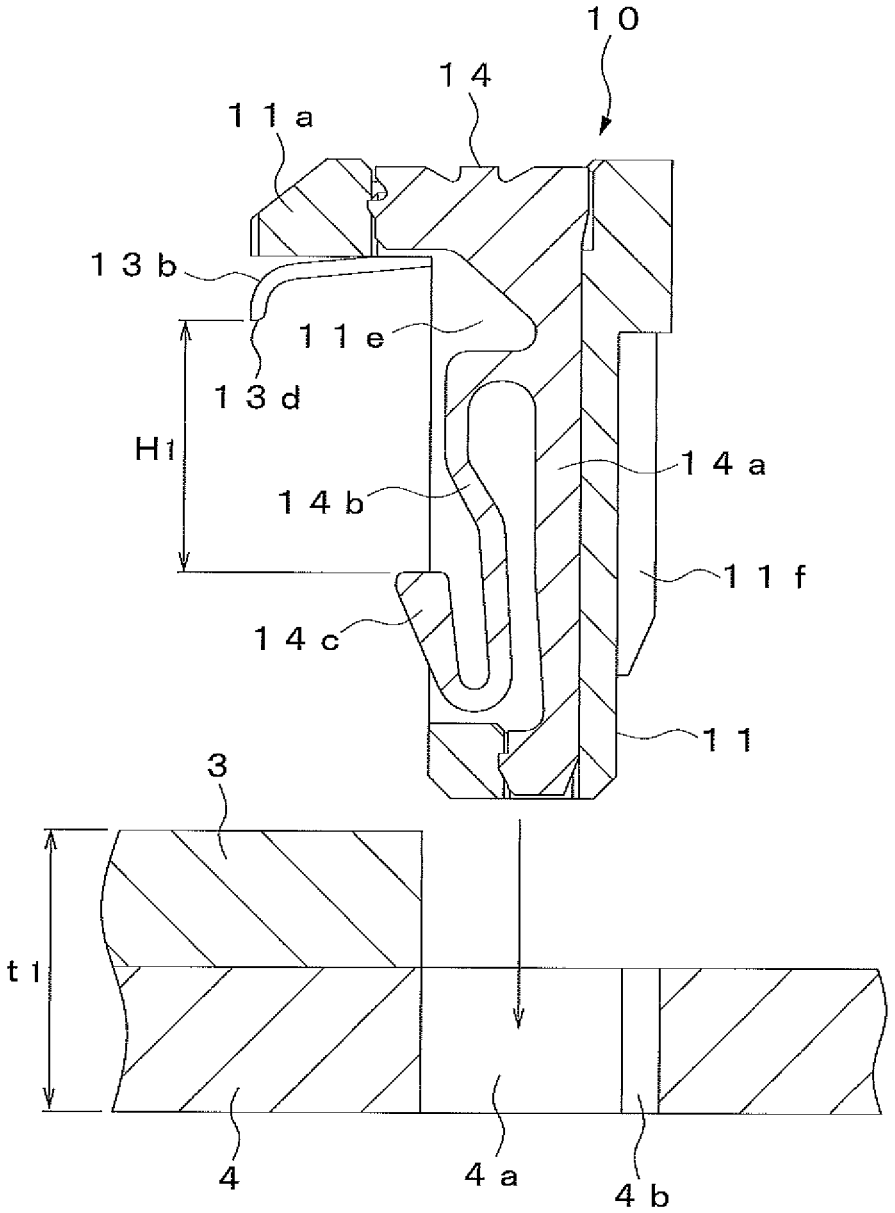
FIG. 18 is a side sectional view showing a mounting process of the connector.
Figure 19:
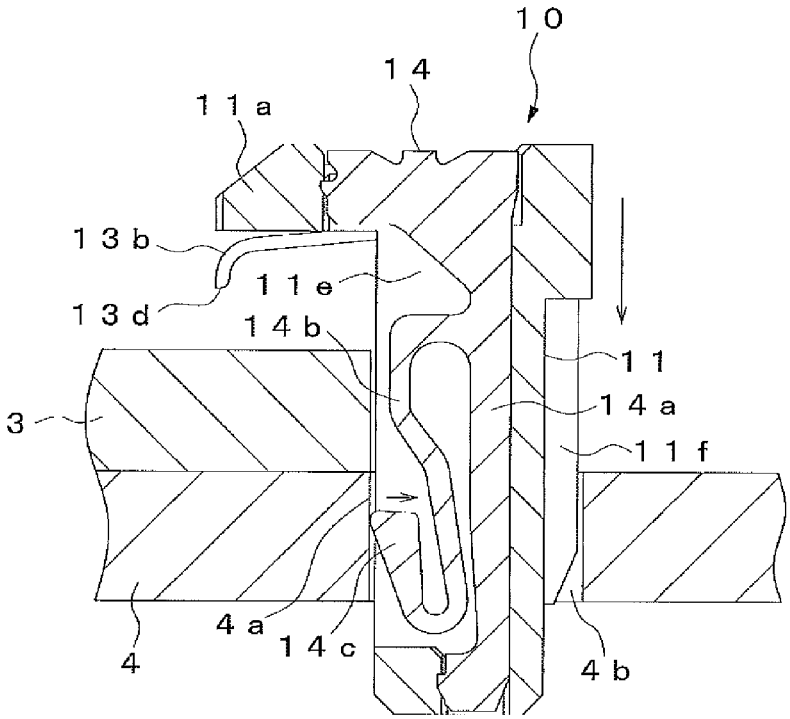
FIG. 19 is a side sectional view showing a mounting process of the connector.
Figure 20:
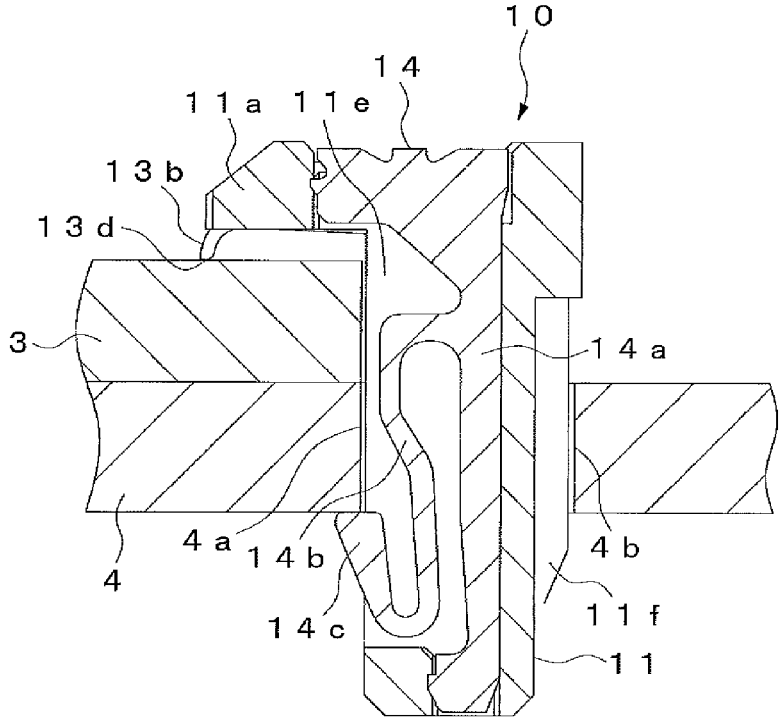
FIG. 20 is a side sectional view showing a mounting state of the connector.

When the connector 10 configured as described above is attached to the LED substrate 3 and the mounting substrate 4, the connector main body 11 is inserted into the mounting hole 4*a* of the mounting substrate 4 from the upper side of the mounting hole 4*a* as shown in FIG. 18. At this time, the rib 11*f* of the connector main body 11 is made to engage with the recessed portion 4*b* of the mounting hole 4*a*. Further, when the connector main body 11 is inserted into the mounting hole 4*a*, and when the locking portion 14*c* of each of the locking members 14 is brought into contact with the upper edge of the LED substrate 3, the elastic piece portion 14*b* is elastically deformed rearward by the inclination of the lower end side of the locking portion 14*c*, so that the locking portion 14*c* is displaced rearward in the holding hole 11*e* while being in contact with the inner surface of the mounting hole 4*a* as shown in FIG. 19. Then, when the locking portion 14*c* goes over the inner surface of the mounting hole 4*a*, the elastic piece portion 14*b* is restored to its original shape to enable the locking portion 14*c* to be displaced frontward, and thereby the locking portion 14*c* is locked to the lower surface of the mounting substrate 4 as shown in FIG. 20. Further, when the connector main body 11 is inserted into the mounting hole 4*a*, the contact 13*d* of the contact portion 13*b* of the terminal 13 is brought into contact with the upper surface of the LED substrate 3, and also the contact portion 13*b* is elastically deformed upward, so that the contact 13*d* is brought into press-contact with the LED substrate 3 by the restoring force of the contact portion 13*b*. Thereby, the contact portion 13*b* is made conductive with the conductive pattern (not shown) of the LED substrate 3, so that the terminal 13 is connected to the LED substrate 3. At this time, a gap H1, which is formed before the elastic deformation and which extends vertically between the contact 13*d* of the contact portion 13*b* and the locking portion 14*c*, is made slightly smaller than the thickness t1 of the LED substrate 3 and the mounting substrate 4. Thereby, when the locking portion 14*c* is locked to the lower surface of the mounting substrate 4, the contact portion 13*b* of the terminal 13 is brought into press-contact with the upper surface of the LED substrate 3, so that the connector main body 11 in the mounting hole 4*a* is held in a state where the vertical movement of the connector main body 11 is regulated with respect to the LED substrate 3 and the mounting substrate 4. Further, the rib 11*f* of the connector main body 11 is engaged with the recessed portion 4*b* of the mounting hole 4*a*, and thereby the movement of the connector 10 in the width direction is regulated.

Figure 14:
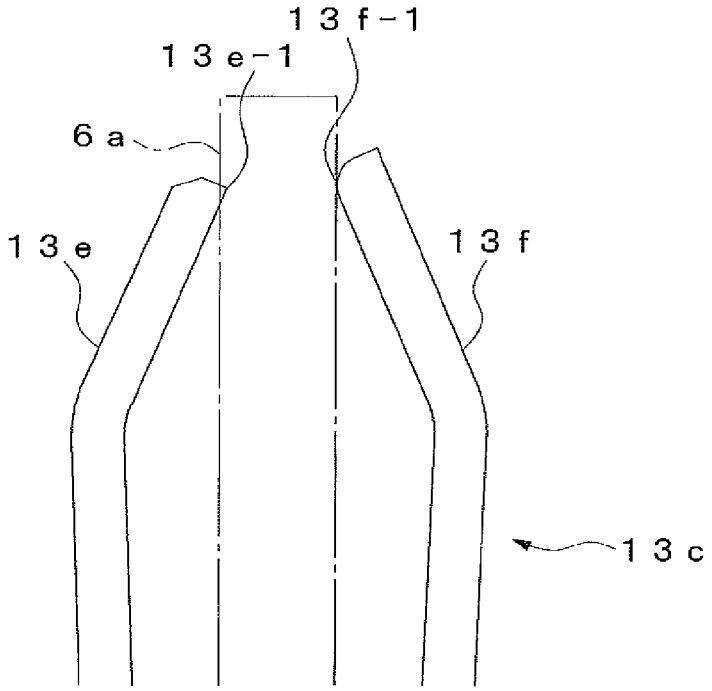
FIG. 14 is a front view of a main portion of the terminal, showing a cable connection state.
Figure 15:
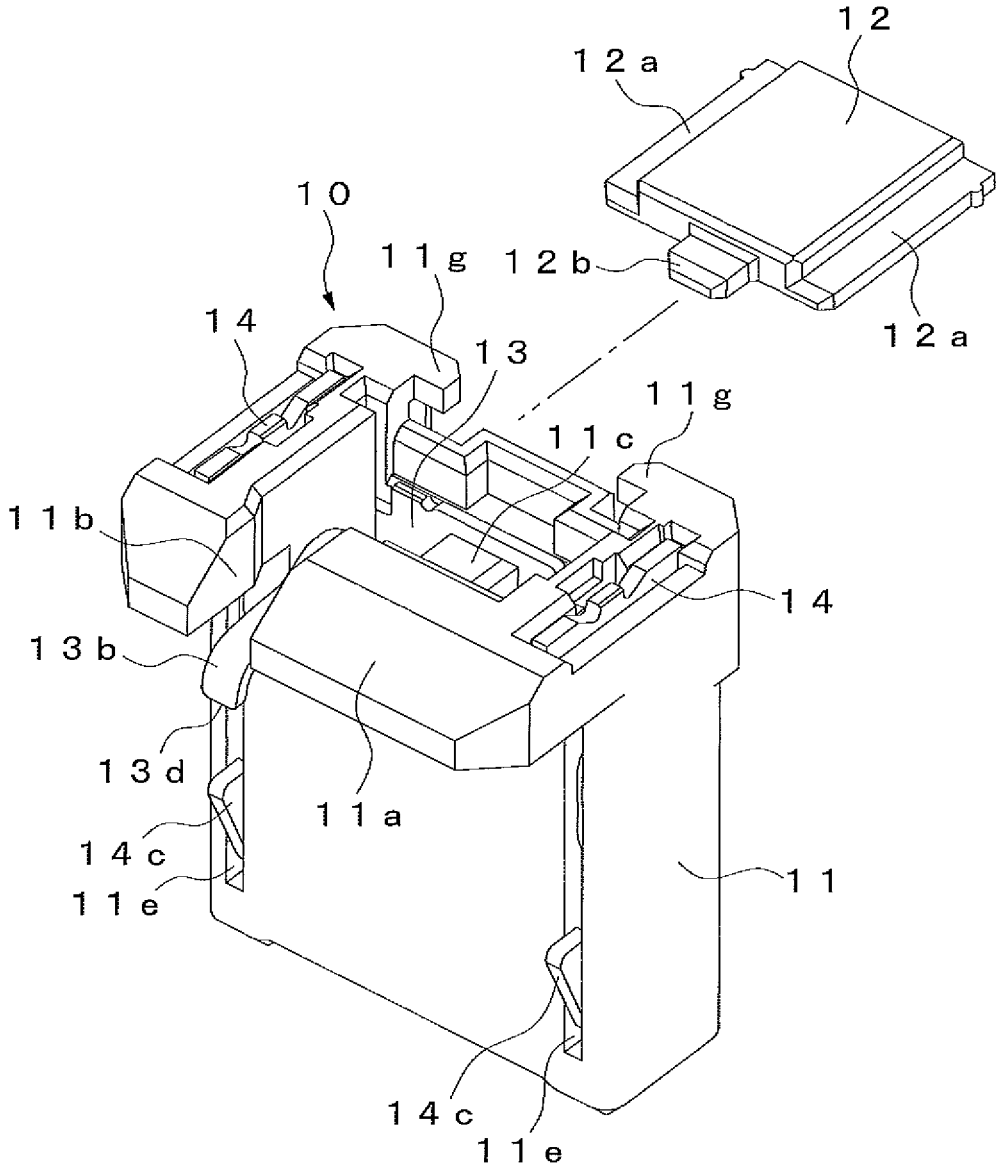
FIG. 15 is an upper side exploded perspective view showing the connector.
Figure 16:
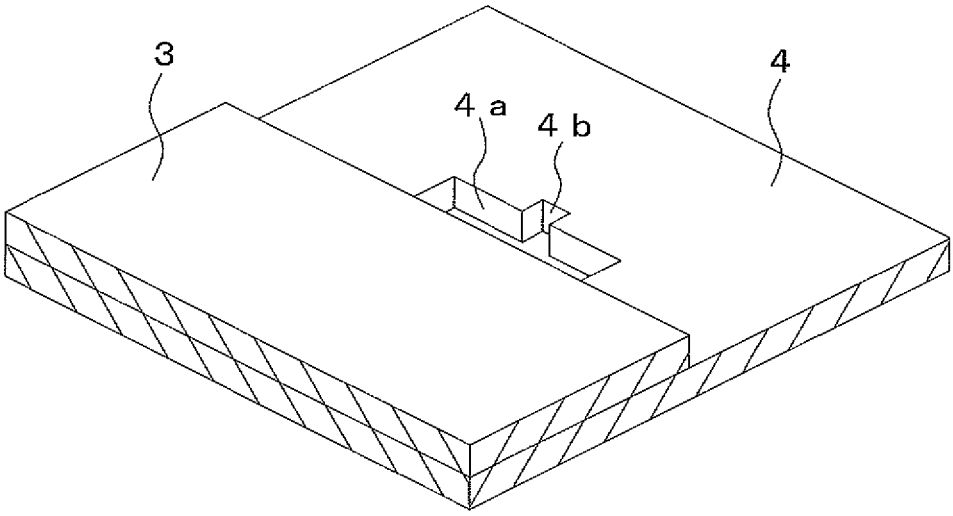
FIG. 16 is a perspective view showing a part of an LED substrate and a mounting substrate.
Figure 17:
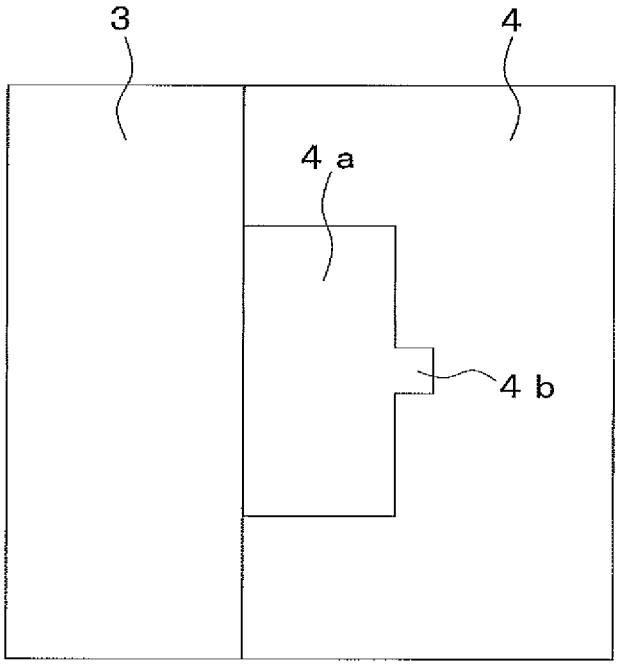
FIG. 17 is a plan view showing a part of the LED substrate and the mounting substrate.

Next, the cable 6, the conducting wire 6*a* of which is exposed by removing the sheath at distal end portion of the cable 6, is inserted into the insertion port 11*d* of the connector main body 11, and thereby the cable 6 is connected to the terminal 13. At this time, the conducting wire 6*a* of the cable 6 is inserted between the respective contact pieces 13*e* and 13*f* of the cable connecting portion 13*c* as shown in FIG. 14, so that the gap between the contact pieces 13*e* and 13*f* is expanded while each of the contact pieces 13*e* and 13*f* is in contact with the conducting wire 6*a*. Thereby, each of the contact pieces 13*e* and 13*f* is brought into press-contact with the conducting wire 6*a*, so that the cable 6 is connected to the terminal 13. At this time, since the first contact portion 13*e*-1 of the first contact piece 13*e* is brought into biting contact with the conducting wire 6*a*, the movement of the conducting wire 6*a*in the direction opposite to the insertion direction is regulated, so that the conducting wire 6*a*is prevented from coming off from the cable connecting portion 13*c*. Further, the second contact portion 13*f*-1 of the second contact piece 13*f* is slidably brought into surface contact with the conducting wire 6*a*without biting into the conducting wire 6*a*, and hence the contact area between the second contact piece 13*f* and the conducting wire 6*a*is sufficiently secured. In this case, the first and second contact portions 13*e*-1 and 13*f*-1 are arranged so as to face each other in the direction perpendicular to the insertion direction of the conducting wire 6*a*, and hence the pressing force from each of the contact portions 13*e*-1 and 13*f*-1 is applied at the same position in the axis direction of the conducting wire 6*a*.

Figure 21:
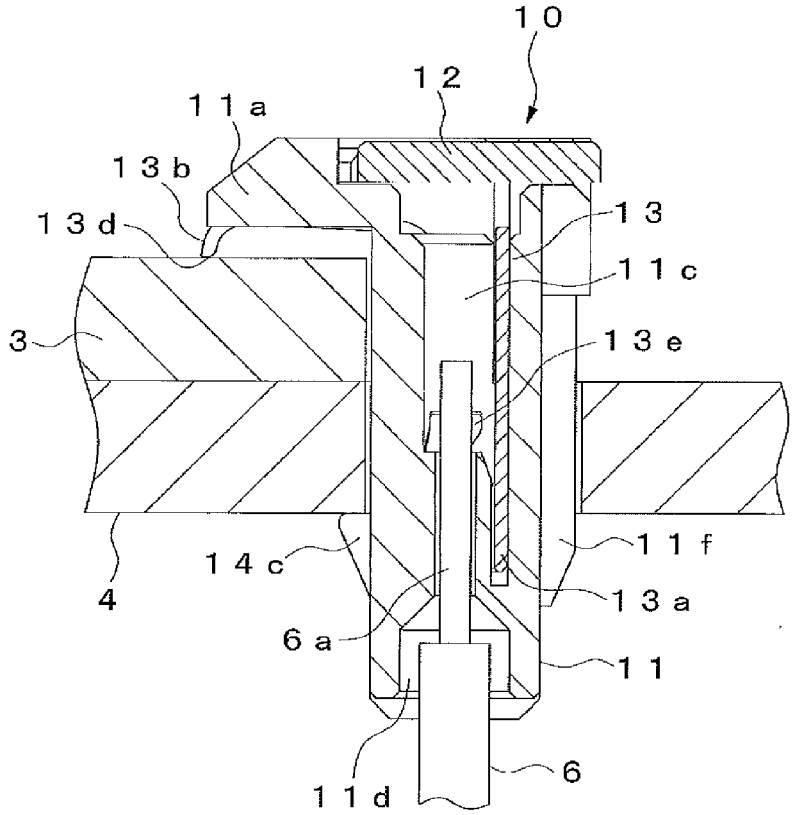
FIG. 21 is a side sectional view showing the mounting state of the connector.
Figure 22:
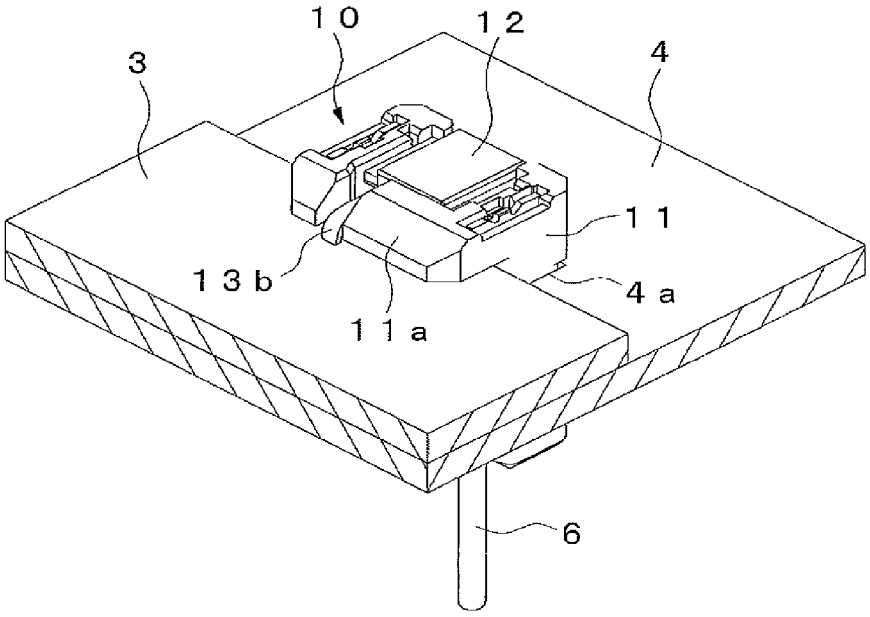
FIG. 22 is a perspective view showing a part of the LED substrate and the mounting substrate and showing the mounting state of the connector.
Figure 23:
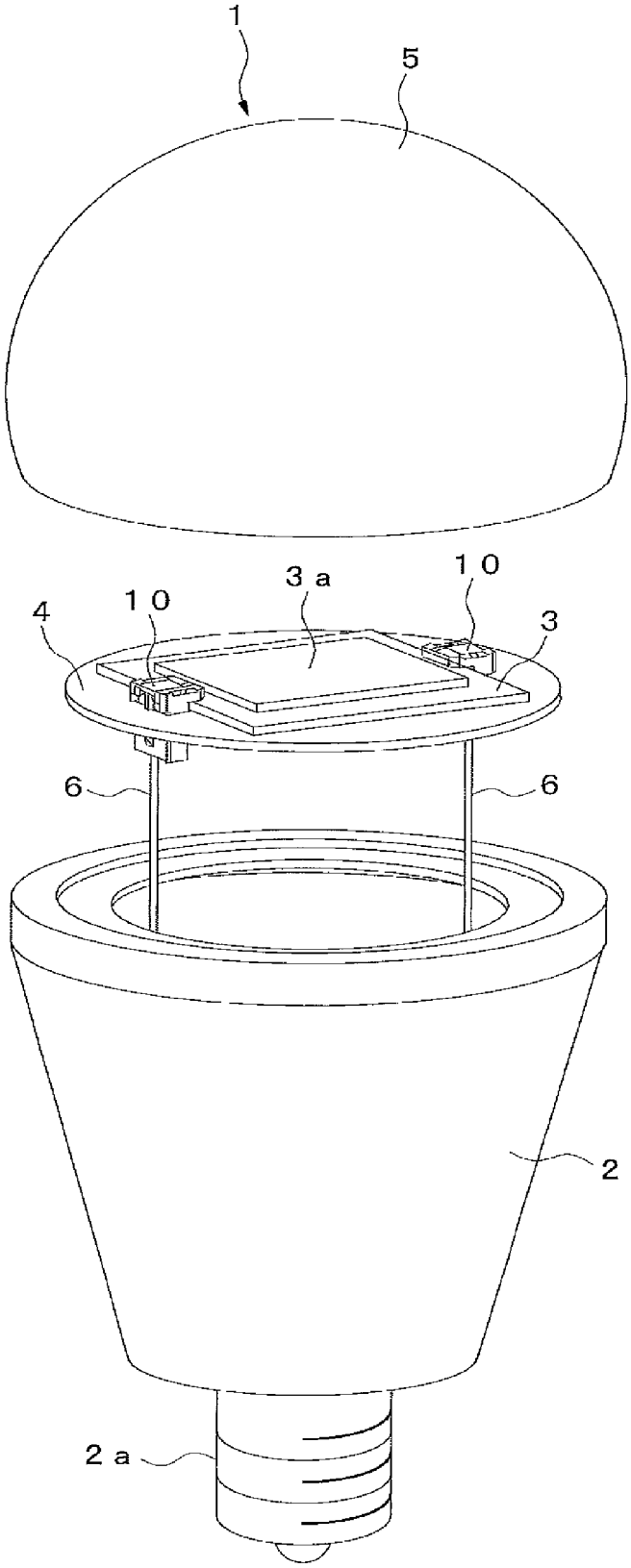
FIG. 23 is an exploded perspective view of a light-bulb type lamp.
Figure 24:
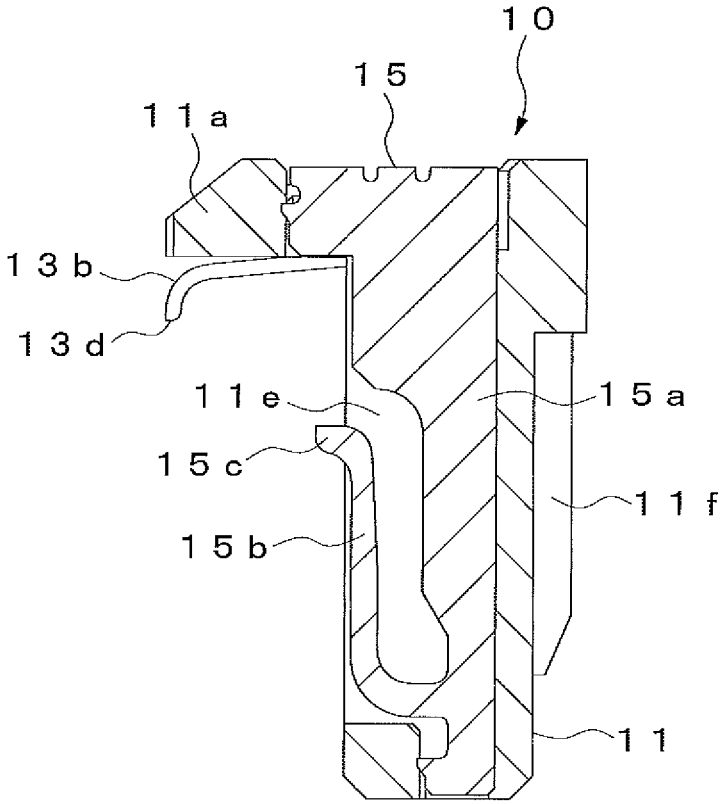
FIG. 24 is a side sectional view of a connector showing a second embodiment according to the present invention.

A pair of the connectors 10 are mounted to the LED substrate 3 and the mounting substrate 4 as shown in FIG. 21. The cable 6 connected to one of the connectors 10 is connected to the positive electrode of the base 2*a*, and the cable 6 connected to the other of the connectors 10 is connected to the negative electrode of the base 2*a*.

In the connector 10 according to the present embodiment, the contact portion 13*b* formed at the terminal 13 so as to be elastically deformable in the vertical direction is brought into contact with the upper surface of the LED substrate 3, so that the contact portion 13*b* is made conductive with the LED substrate 3. Also, the locking portion 14*c* of each of the locking members 14 is locked to the lower surface of the mounting substrate 4, so that the contact portion 13*b* of the terminal 13 is held on the upper surface of the LED substrate 3 in a state where the contact portion 13*b* is in press-contact with the upper surface of the LED substrate 3. Thereby, the terminal 13 can be easily connected to the LED substrate 3 without soldering, and hence the mounting work of the connector 10 can be performed very easily.

In this case, when the connector main body 11 is inserted into the mounting hole 4*a* of the mounting substrate 4, the elastic piece portion 14*b* is elastically deformed rearward while the locking portion 14*c* of each of the locking members 14 is in contact with the edge portion of the mounting hole 4*a*, and then, when the locking portion 14*c* goes over the edge portion of the mounting hole 4*a*, the elastic piece portion 14*b* is restored into its original shape so that the locking portion 14*c* is locked to the lower surface of the mounting substrate 4. Thereby, the insertion resistance at the time when the connector main body 11 is inserted into the mounting hole 4*a* can be reduced by the elastic deformation of the elastic piece portion 14*b*, and also the locking portion 14*c* can be surely locked to the lower surface of the mounting substrate 4 by the restoration of the elastic piece portion 14*b*.

Further, the terminal housing portion 11*c*, in which the terminal 13 is housed from the opening portion located on the upper surface side of the LED substrate 3, is provided in the connector main body 11 so that the upper surface opening portion of the terminal housing portion 11*c* is covered with the upper surface cover 12 mounted to the connector main body 11. Thereby, the inside of the terminal housing portion 11*c* is not exposed to the upper surface of the connector main body 11, so that the light of the LED 3*a* can be surely reflected by the upper surface of the connector main body 11 and the upper surface cover 12. In this case, when the upper surface of the connector main body 11 and the upper surface cover 12 have a color with high reflectance, there is an advantage that, even when the upper surface side of the connector main body 11 is arranged above the upper surface of the LED substrate 3, the upper surface side of the LED substrate 3 is not darkened by the connector main body 11 and hence the lighting effect is prevented from being reduced.

Further, since the terminal 13 is provided integrally with the cable connecting portion 13*c* to which the cable 6 can be connected from the outside, a cable connection terminal needs not be separately provided, and hence the number of components can be reduced.

Further, the first contact portion 13*e*-1, which regulates the movement of the conducting wire 6*a* of the cable 6 in the direction opposite to the insertion direction by biting into the conducting wire 6*a*, is provided at the distal end corner portion of the first contact piece 13*e* of the terminal 13, and also the second contact portion 13*f*-1, which is slidably brought into surface contact with the conducting wire 6*a*, is provided at the distal end of the second contact piece 13*f* of the terminal 13. Thereby, the coming-off of the conducting wire 6*a* can be prevented by the first contact portion 13*e*-1, and the area in contact with the conducting wire 6*a*can be sufficiently secured by the second contact portion 13*f*-1. As a result, the conducting wire 6*a*can be surely held without deteriorating the connection reliability.

In this case, since the second contact portion 13*f*-1 is formed by chamfering the distal end corner portion of the second contact piece 13*f*, the curved-surface-shaped contact needs not be formed by bending the distal end side of the second contact piece 13*f*, and hence the second contact piece 13*f* can be easily formed in a simple shape.

Further, since the first and second contact portions 13*e*-1 and 13*f*-1 are arranged to face each other in the direction perpendicular to the insertion direction of the conducting wire 6*a*, the pressing force from each of the contact portions 13*e*-1 and 13*f*-1 can be applied at the same axial position of the conducting wire 6*a*, and hence the conducting wire 6*a*can be surely sandwiched between the contact portions 13*e* and 13*f*.

Further, the first and second contact pieces 13*e* and 13*f* are formed in such a manner that the both sides of the extension portion 13*g* of the terminal 13 are bent and raised so as to face each other. Therefore, the contact pieces 13*e* and 13*f* can be easily formed, and hence the productivity can be improved.

Note that the locking portion 14*c* is provided at the locking member 14 formed of a component separated from the connector main body 11 in the above-described embodiment, but a locking portion which is locked to the mounting substrate 8 may also be provided integrally with the connector main body.

Further, one surface-shaped LED 3*a* is mounted to the LED substrate 3 in the above-described embodiment, but a plurality of chip-type LEDs may also be mounted to the LED substrate 3.

Further, the connector 10 is connected to the LED substrate 3 of the light-bulb type lamp in the above-described embodiment, but the present invention is not limited to the case where the connector 10 is used for the light-bulb type lamp substrate. The present invention can also be applied to a connector which is connected to a substrate of another apparatus.

FIG. 24 to FIG. 28 show a second embodiment according to the present invention, and the same components as those in the above-described embodiment are denoted by the same reference numerals and characters.

A connector 10 of the present embodiment is attached to an LED substrate 7 and a mounting substrate 8, each of which has a thickness dimension smaller than those in the first embodiment. In place of the locking member 14 of the first embodiment, the connector 10 of the present embodiment is provided with a pair of locking members 15 corresponding to the thickness dimension each of the LED substrate 7 and the mounting substrate 8 according to the present embodiment. Note that an LED (not shown) is mounted on the upper surface of the LED substrate 7, and a mounting hole 8*a* and a recessed portion 8*b* are provided in the mounting substrate 8 similarly to the first embodiment.

Each of the locking members 15 according to the present embodiment is made of a metal plate formed by punching and is mounted to the connector main body 11. The locking member 15 is configured by a fixed piece portion 15*a* extending from the upper end to the lower end of the inside of a holding hole 11*e*, an elastic piece portion 15*b* extending from the fixed piece portion 15*a*, and a locking portion 15*c* provided at the distal end of the elastic piece portion 15*b*. The locking portion 15*c* is configured to be locked to the lower surface (the other surface in the thickness direction) of the mounting substrate 4. The fixed piece portion 15*a* is configured to be fixed to the holding hole 11*e* in such manner that both front and rear ends of each of the upper and lower end sides of the fixed piece portion 15*a* are brought into press-contact with the inner surface of the holding hole 11*e*.

The elastic piece portion 15*b* is formed to extend frontward from the lower end side of the fixed piece portion 15*a* and is bent upward so as to extend upward from the bent portion. The locking portion 15*c* is formed to project frontward from the upper end of the elastic piece portion 15*b*, and projects frontward from the opening portion of the holding hole 11*e*. In this case, the upper end of the locking portion 15*c* is formed horizontally, and the lower end side of the locking portion 15*c* is formed in a shape inclined rearward and downward.

Figure 25:
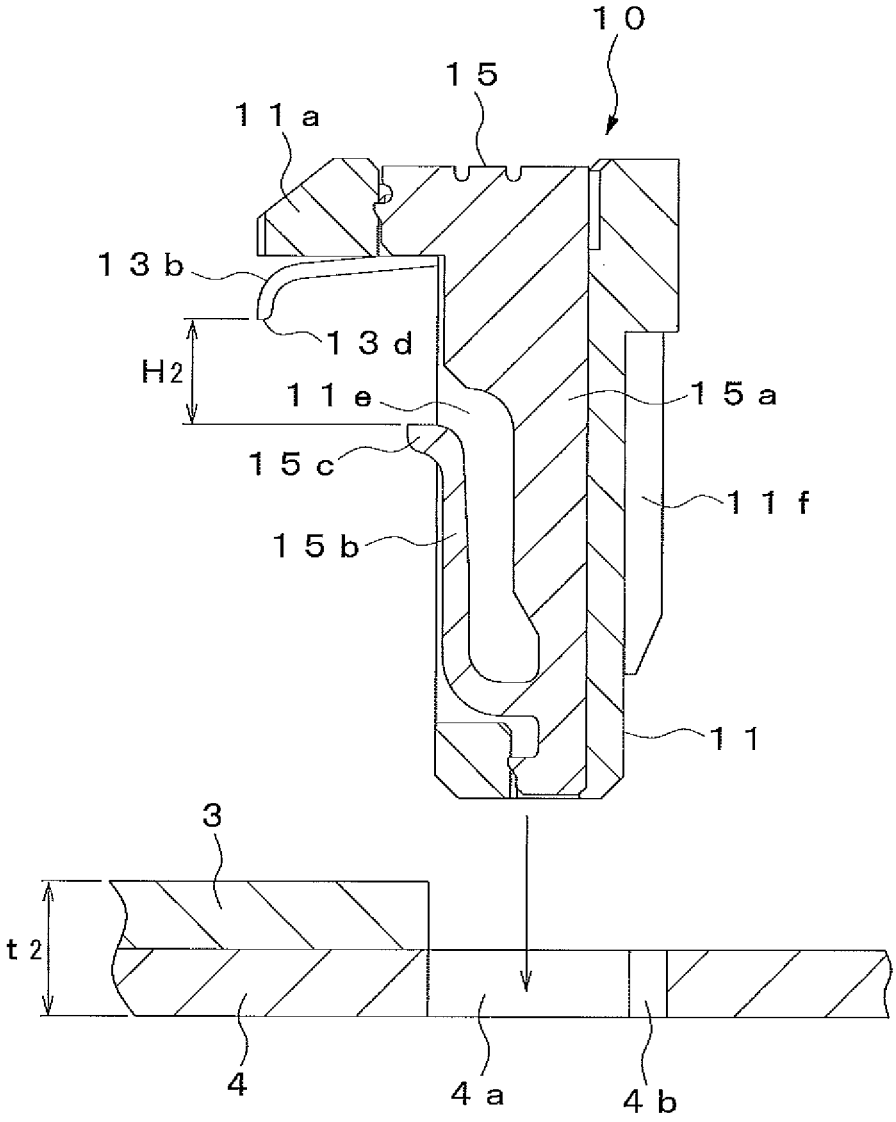
FIG. 25 is a side sectional view showing a mounting process of the connector.
Figure 26:
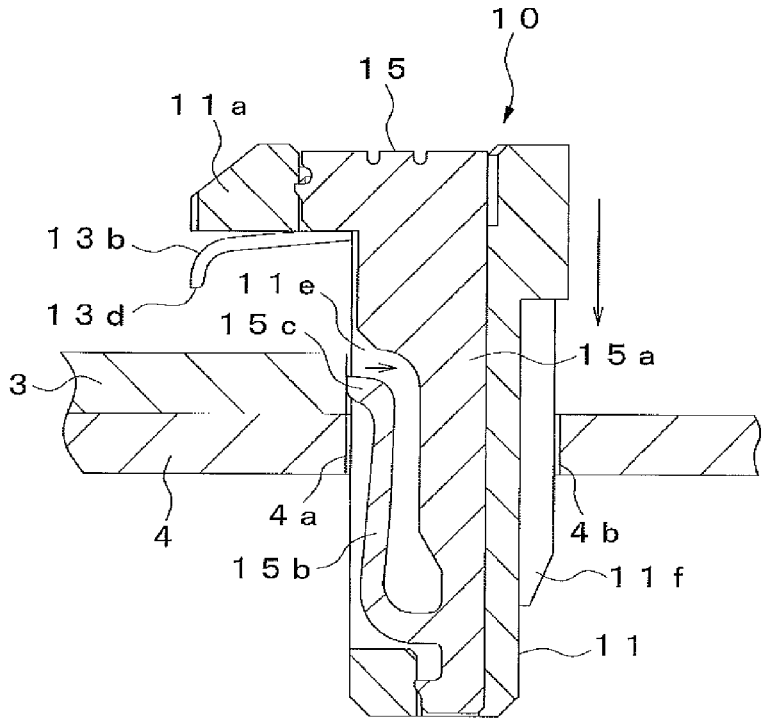
FIG. 26 is a side sectional view showing a mounting process of the connector.
Figure 27:
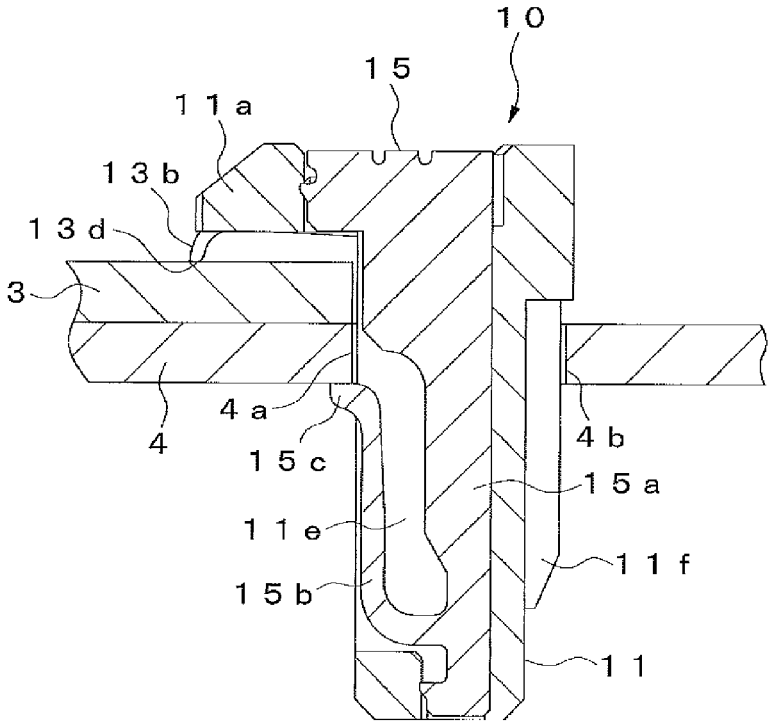
FIG. 27 is a side sectional view showing a mounting state of the connector.

In the present embodiment, when the connector 10 is mounted to the LED substrate 7 and the mounting substrate 8, the connector main body 11 is inserted into the mounting hole 8*a* of the mounting substrate 8 from above the mounting substrate 8 as shown in FIG. 25. At this time, a rib 11*f* of the connector main body 11 is made to engage with the recessed portion 8*b* of the mounting hole 8*a*. Further, when the connector main body 11 is inserted into the mounting hole 8*a*, and when the locking portion 15*c* of each of the locking members 15 is brought into contact with the upper edge of the LED substrate 7, the elastic piece portion 15*b* is elastically deformed rearward by the inclination of the lower end side of the locking portion 15*c*, so that the locking portion 15*c* is displaced rearward in the holding hole 11*e* while being in contact with the inner surface of the mounting hole 8*a* as shown in FIG. 26. Then, when the locking portion 15*c* goes over the inner surface of the mounting hole 8*a*, the elastic piece portion 15*b* is restored to its original shape to enable the locking portion 15*c* to be displaced frontward, and thereby the locking portion 15*c* is locked to the lower surface of the mounting substrate 8 as shown in FIG. 27. Further, when the connector main body 11 is inserted into the mounting hole 8*a*, a contact 13*d* of a contact portion 13*b* of a terminal 13 is brought into contact with the upper surface of the LED substrate 7, and also the contact portion 13*b* is elastically deformed upward, so that the contact 13*d* is brought into press-contact with the LED substrate 7 by the restoring force of the contact portion 13*b*. Thereby, the contact portion 13*b* is made conductive with the conductive pattern (not shown) of the LED substrate 7, so that the terminal 13 is connected to the LED substrate 7. At this time, a gap H2, which is formed before the elastic deformation and which extends vertically between the contact 13*d* of the contact portion 13*b* and the locking portion 15*c*, is made slightly smaller than the thickness t2 of the LED substrate 7 and the mounting substrate 8. Thereby, when the locking portion 15*c* is locked to the lower surface of the mounting substrate 8, the contact portion 13*b* of the terminal 13 is brought into press-contact with the upper surface of the LED substrate 7, so that the connector main body 11 in the mounting hole 8*a* is held in a state where the vertical movement of the connector main body is regulated with respect to the LED substrate 7 and the mounting substrate 8. Further, the rib 11*f* of the connector main body 11 is engaged with the recessed portion 8*b* of the mounting hole 8*a*, and thereby the movement of the connector 10 in the width direction is regulated.

Figure 28:
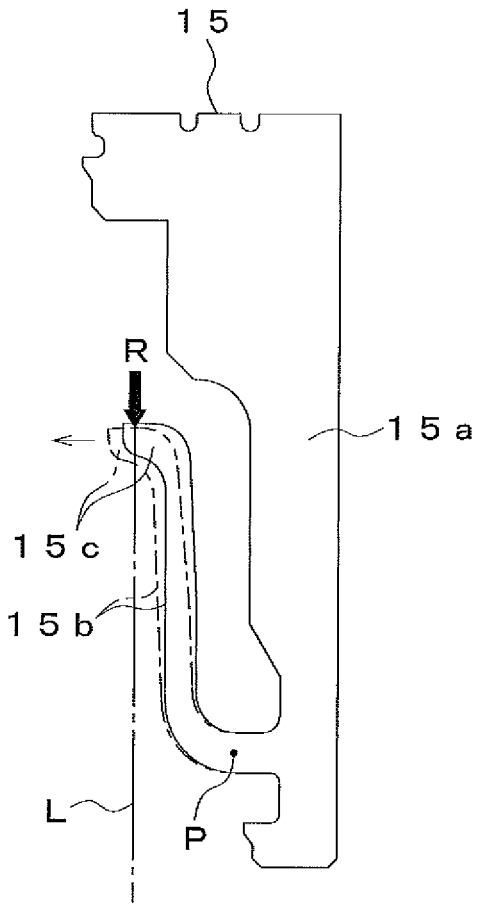
FIG. 28 is a side view of a locking member showing a displacement state of a locking portion.

Further, in the above-described mounting state, when a force is applied to the connector main body 11 in the direction opposite to the direction of insertion into the mounting hole 8*a*, the locking portion 15*c* of the locking member 15 receives a downward counter force R from the lower surface of the mounting substrate 8 as shown in FIG. 28. At this time, the elastic piece portion 15*b* is elastically deformed with the lower end side bent portion as a fulcrum P. However, the fulcrum P is located on the rear side relative to an extension line L in the direction in which the counter force R is applied, and hence a counterclockwise rotation moment in FIG. 28 is generated around the fulcrum P. Thereby, the elastic piece portion 15*b* is elastically deformed frontward as shown by the broken-dotted line in FIG. 28, and the locking portion 15*c* is displaced frontward while being locked to the lower surface of the mounting substrate 8. Therefore, even when a force is applied to the connector main body 11 in the direction opposite to the insertion direction, the locking between the locking portion 15*c* and the mounting substrate 8 is not released.

In the present embodiment, the connector 10 is configured such that the locking member 15, in which the gap between the contact 13*d* of the contact portion 13*b* and the locking portion 15*c* is different from the gap in the locking member 14 of the first embodiment, can be mounted to the connector main body 11 in place of the locking member 14 of the first embodiment. Therefore, only by replacing the locking member 14 with the locking member 15, the connector 10 can be mounted to the LED substrate 7 and the mounting substrate 8 which have a thickness dimension different from that of the LED substrate 3 and mounting substrate 4 of the first embodiment, and hence the versatility of the connector 10 can be improved.

In this case, since the opening portion of the holding hole 11*e* of the connector main body 11 is formed to have a length substantially covering the entire vertical length of the front surface of the connector main body 11 except the extension portion 11*a*, even when the height position of the locking portion 15*c* of the locking member 15 is different from that of the locking portion 14*c* of the first embodiment, the locking portion 15*c* of the present embodiment can be arranged at the opening portion of the holding hole 11*e*.

Further, when a force is applied to the connector main body 11 in the direction opposite to the direction of insertion into the mounting hole 8*a*, the elastic piece portion 15*b* is elastically deformed in the direction (in the front direction) opposite to the deformation direction (in the rear direction) at the time of insertion, while the locking portion 15*c* is locked to the lower surface of the mounting substrate 8. Therefore, even when a force is applied to the connector main body 11 in the direction opposite to the insertion direction, the locking between the locking portion 15*c* and the mounting substrate 8 is not released, and hence the connector main body 11 can be surely mounted to the LED substrate 7 and the mounting substrate 8.

Note that the other configurations and effects in the present embodiment are substantially the same as those of the first embodiment.

REFERENCE SIGNS LIST

1 . . . Light-bulb type lamp
3 . . . LED substrate

4 . . . Mounting substrate
4*a* . . . Mounting hole
6 . . . Cable
7 . . . LED substrate
8 . . . Mounting substrate
8*a* . . . Mounting hole
10 . . . Connector
11 . . . Connector main body
11*c* . . . Terminal housing portion
12 . . . Upper surface cover
13 . . . Terminal
13*b* . . . Contact portion
13*c* . . . Cable connecting portion
13*e* . . . First contact piece
13*f* . . . Second contact piece
13*e*-1 . . . First contact portion
13*f*-1 . . . Second contact portion
14 . . . Locking member
14*b* . . . Elastic piece portion
14*c* . . . Locking portion
15 . . . Locking member
15*b* . . . Elastic piece portion
15*c* . . . Locking portion

The invention claimed is:

1. A connector comprising:

a connector main body configured to be inserted into a mounting hole provided in a plate-like mounting object;

a terminal held at the connector main body, the terminal configured to be connected to one surface of the mounting object, the one surface being perpendicular to a thickness direction of the mounting object;

a contact portion of the terminal elastically deformable in the thickness direction of the mounting object and electrically conductive with the mounting object when in contact with the one surface of the mounting object; and a locking member mounted to the connector main body and comprising a locking portion configured to be locked to an opposite surface of the mounting object, the opposite surface being perpendicular to the thickness direction of the mounting object, the locking member thereby holding the contact portion of the terminal in press-contact with the one surface of the mounting object, wherein the locking member is formed so that a gap between the contact portion and the locking portion is smaller than a thickness dimension of the mounting object, the connector main body is held at the mounting object by the mounting object being sandwiched between the contact portion and the locking portion, and the connector main body is formed so as to be able to mount therein a plurality of kinds of locking members respectively having different gaps between the contact portion and the locking portion.

2. The connector according to claim 1, wherein the locking portion is provided at an elastically deformable elastic piece portion, and when the connector main body is inserted into the mounting hole from the side of the one surface of the mounting object, the elastic piece portion is elastically deformed in a predetermined direction while the locking portion is in contact with an edge portion of the mounting hole, and when the elastic piece portion goes over the edge portion of the mounting hole, the elastic piece portion is restored to the original shape of the elastic piece portion and the locking portion is locked to the opposite surface of the mounting object.

3. The connector according to claim 2, wherein, when a force is applied to the connector main body in a direction opposite to a direction of insertion into the mounting hole, the elastic piece portion is elastically deformed in a direction opposite to the predetermined direction while the locking portion is locked to the opposite surface of the mounting object.

4. The connector according to claim 1, further comprising:

a terminal housing portion provided in the connector main body and configured to house therein the terminal from an opening portion located on a side of the connector corresponding to the one surface of the mounting object; and a cover configured to cover the opening portion of the terminal housing portion by being mounted to the connector main body.

5. The connector according to claim 1, wherein the terminal comprises a cable connecting portion configured so that a cable can be connected from an outside.

6. A substrate assembly comprising:

a plate-like mounting object comprising a substrate with a light-emitting diode (LED) mounted thereto; and a connector comprising:

a connector main body configured to be inserted into a mounting hole provided in the plate-like mounting object;

a terminal held at the connector main body, the terminal configured to be connected to one surface of the mounting object, the one surface being perpendicular to a thickness direction of the mounting object;

a contact portion of the terminal elastically deformable in the thickness direction of the mounting object and electrically conductive with the mounting object when in contact with the one surface of the mounting object; and a locking member mounted to the connector main body and comprising a locking portion configured to be locked to an opposite surface of the mounting object, the opposite surface being perpendicular to the thickness direction of the mounting object, the locking member thereby holding the contact portion of the terminal in press-contact with the one surface of the mounting object, wherein the locking member is formed so that a gap between the contact portion and the locking portion is smaller than a thickness dimension of the mounting object, the connector main body is held at the mounting object by the mounting object being sandwiched between the contact portion and the locking portion, and the connector main body is formed so as to be able to mount therein a plurality of kinds of locking members respectively having different gaps between the contact portion and the locking portion.

7. The substrate assembly according to claim 6, wherein the locking portion is provided at an elastically deformable elastic piece portion, and when the connector main body is inserted into the mounting hole from the side of the one surface of the mounting object, the elastic piece portion is elastically deformed in a predetermined direction while the locking portion is in contact with an edge portion of the mounting hole, and when the elastic piece portion goes over the edge portion of the mounting hole, the elastic piece portion is restored to the original shape of the elastic piece portion and the locking portion is locked to the opposite surface of the mounting object.

8. The substrate assembly according to claim 7, wherein, when a force is applied to the connector main body in a direction opposite to a direction of insertion into the mounting hole, the elastic piece portion is elastically deformed in a direction opposite to the predetermined direction while the locking portion is locked to the opposite surface of the mounting object.

9. The substrate assembly according to claim 6, further comprising:

a terminal housing portion provided in the connector main body and configured to house therein the terminal from an opening portion located on a side of the connector corresponding to the one surface of the mounting object; and a cover configured to cover the opening portion of the terminal housing portion by being mounted to the connector main body.

10. The substrate assembly according to claim 6, wherein the terminal comprises a cable connecting portion configured so that a cable can be connected from an outside.

11. A lamp comprising:

a plate-like mounting object comprising a substrate and a light source; and a connector comprising:

a connector main body configured to be inserted into a mounting hole provided in the plate-like mounting object;

a terminal held at the connector main body, the terminal configured to be connected to one surface of the mounting object, the one surface being perpendicular to a thickness direction of the mounting object;

a contact portion of the terminal elastically deformable in the thickness direction of the mounting object and electrically conductive with the mounting object when in contact with the one surface of the mounting object; and a locking member mounted to the connector main body and comprising a locking portion configured to be locked to an opposite surface of the mounting object, the opposite surface being perpendicular to the thickness direction of the mounting object, the locking member thereby holding the contact portion of the terminal in press-contact with the one surface of the mounting object, wherein the locking member is formed so that a gap between the contact portion and the locking portion is smaller than a thickness dimension of the mounting object, the connector main body is held at the mounting object by the mounting object being sandwiched between the contact portion and the locking portion, and the connector main body is formed so as to be able to mount therein a plurality of kinds of locking members respectively having different gaps between the contact portion and the locking portion.

12. The lamp according to claim 11, wherein the locking portion is provided at an elastically deformable elastic piece portion, and when the connector main body is inserted into the mounting hole from the side of the one surface of the mounting object, the elastic piece portion is elastically deformed in a predetermined direction while the locking portion is in contact with an edge portion of the mounting hole, and when the elastic piece portion goes over the edge portion of the mounting hole, the elastic piece portion is restored to the original shape of the elastic piece portion and the locking portion is locked to the opposite surface of the mounting object.

13. The lamp according to claim 12, wherein, when a force is applied to the connector main body in a direction opposite to a direction of insertion into the mounting hole, the elastic piece portion is elastically deformed in a direction opposite to the predetermined direction while the locking portion is locked to the opposite surface of the mounting object.

14. The lamp according to claim 11, further comprising:

a terminal housing portion provided in the connector main body and configured to house therein the terminal from an opening portion located on a side of the connector corresponding to the one surface of the mounting object; and a cover configured to cover the opening portion of the terminal housing portion by being mounted to the connector main body.

15. The lamp according to claim 11, wherein the terminal comprises a cable connecting portion configured so that a cable can be connected from an outside.

* * * * *